United States Patent [19]

Kimbrell, Sr., deceased

[11] 4,418,863

[45] Dec. 6, 1983

[54] PRODUCE TRAY WITH REINFORCED CORNER CONSTRUCTION

[75] Inventor: Melvin D. Kimbrell, Sr., deceased, late of Burlingame, Calif., by Melvin D. Kimbrell, Jr., executor

[73] Assignee: Georgia-Pacific Corporation, Portland, Oreg.

[21] Appl. No.: 414,496

[22] Filed: Sep. 2, 1982

[51] Int. Cl.[3] ..... B65D 5/22; B65D 5/26

[52] U.S. Cl. ..... 229/49; 229/32; 229/33

[58] Field of Search ..... 229/49, 32, 33, 36

[56] References Cited

U.S. PATENT DOCUMENTS

| | | | |
|---|---|---|---|
| 1,653,116 | 12/1927 | Parks . | |
| 1,996,965 | 4/1935 | Keppler . | |
| 2,350,932 | 6/1944 | Schaefer . | |
| 2,665,836 | 1/1954 | Rendall | 229/32 |
| 2,705,588 | 4/1955 | Huckstep . | |
| 2,885,137 | 5/1959 | Guyer . | |
| 3,184,136 | 5/1965 | Forbes | 229/49 |
| 3,207,414 | 9/1965 | Locke | 229/49 |
| 3,918,630 | 11/1975 | Meyers . | |
| 4,082,215 | 4/1978 | Eichenauer . | |
| 4,265,393 | 5/1981 | Orchard | 229/36 |

FOREIGN PATENT DOCUMENTS

| | | | |
|---|---|---|---|
| 2446231 | 8/1980 | France | 229/49 |
| 1528491 | 10/1978 | United Kingdom | 229/49 |
| 1544817 | 4/1979 | United Kingdom | 229/49 |

*Primary Examiner*—Herbert F. Ross

*Attorney, Agent, or Firm*—Schuyler, Banner, Birch, McKie & Beckett

[57] ABSTRACT

A rectangular tray for produce such as cauliflower has a reinforced corner construction formed by a corner flap extending from one side wall of the tray blank that is folded into a columnar configuration at the end of such wall, an adjoining end wall having a top flap folded down to overlie the column, a locking flap extending from the top flap and folded down to lie along the outside of the one side wall with the locking flap having a tab insertable into a slot adjacent the juncture of the one side wall with the tray bottom, and retaining means cooperating with the folded corner flap to retain the columnar configuration between the tray bottom and top flap.

7 Claims, 6 Drawing Figures

PRODUCE TRAY WITH REINFORCED CORNER CONSTRUCTION

BACKGROUND OF THE INVENTION

This invention relates to the art of tray type containers commonly constructed of corrugated paperboard suitable for produce such as cauliflower and the like. More particularly, the invention relates to a container tray having a reinforced corner construction wherein a multiple of such trays may be loaded with produce, stacked in sizeable number and thereupon be transported and stored as necessary in handling the product while protecting it incident such transportation, storage, etc.

Rectangular trays folded from suitably cut and scored paperboard blanks have gained wide acceptance in the packaging industry for handling and merchandising a wide variety of products. Trays of this type incorporating various reinforced corner constructions have been proposed as being better able to withstand high stacking loads during storage, shipping and other handling of goods contained within a number of stacked trays.

While several such paperboard tray constructions with reinforced corners are known and employed commercially, the folded tray construction embodied in the instant invention is believed to offer greater load carrying capability in multiple stacking environments. The invention offers a highly simple and efficient form such that lighter weight and thus more economical paperboard can be employed to gain the same tray strength in the corner construction as the tray constructions heretofore known in the industry.

Prior art solutions to the problems of providing a produce tray that may be easily assembled at the field site from a paperboard blank into a strong tray which can be stacked in multiples with the produce contained therein have been overly complex or required unduly heavy and expensive paperboard to achieve the requisite tray strength.

SUMMARY OF THE INVENTION

It is therefore a principal object of the present invention to provide a rectangular tray suitable for produce such as cauliflower and the like which is characterized by its simplicity in folding into the tray configuration from a panel blank to give reinforced corners for the tray.

It is a further object of the present invention to provide a tray type container which is easily folded into the tray configuration from a single panel blank and does not require the use of staples, glue, tape or auxiliary equipment for assembly at the site for its use.

Another object of the invention is the provision of a rectangular tray suitable for produce which is characterized by a reinforced corner construction having a columnar configuration such that lighter weight paperboard may be employed while still achieving the requisite tray strength for multiple tray stacking when loaded with produce or other products.

Also, an object of the invention is to provide a rectangular tray having reinforced corners with a columnar configuration disposed between the tray bottom wall and a partial top wall, the tray being formed from a single panel blank folded into the tray configuration.

These and other objects of the invention are accomplished by a tray panel blank providing side and end walls hingedly connected to and extending upwardly from the edges of a bottom wall to substantially define the dimensions of the tray, a corner flap extending longitudinally from a first side wall that is folded into a columnar configuration at the end of this first side wall, a top flap extending upwardly from an end wall that adjoins the first side wall with this top flap being folded down to provide a partial top wall overlying the columnar configuration with holding means maintaining the walls in the tray configuration and retaining means cooperating with the corner flap to retain the columnar configuration disposed between the bottom wall and the partial top wall. Preferably, the material of the tray is of a semi-rigid character such as corrugated paperboard. The retaining means for the columnar configuration of the corner flap may be provided by a retaining tab on an edge of the corner flap engaged with an opening formed in one of the tray walls or it may be provided by a retaining tongue incised from one of the tray walls with the tongue engaging a wall portion of the corner flap to retain the columnar configuration.

BRIEF DESCRIPTION OF THE DRAWINGS

The novel features of this invention are particularly recited in the appended claims, but the invention will be understood more fully and clearly from the following detailed description of the invention given with reference to the accompanying drawings in which:

DESCRIPTION OF PREFERRED EMBODIMENTS OF THE INVENTION

Figure 1:
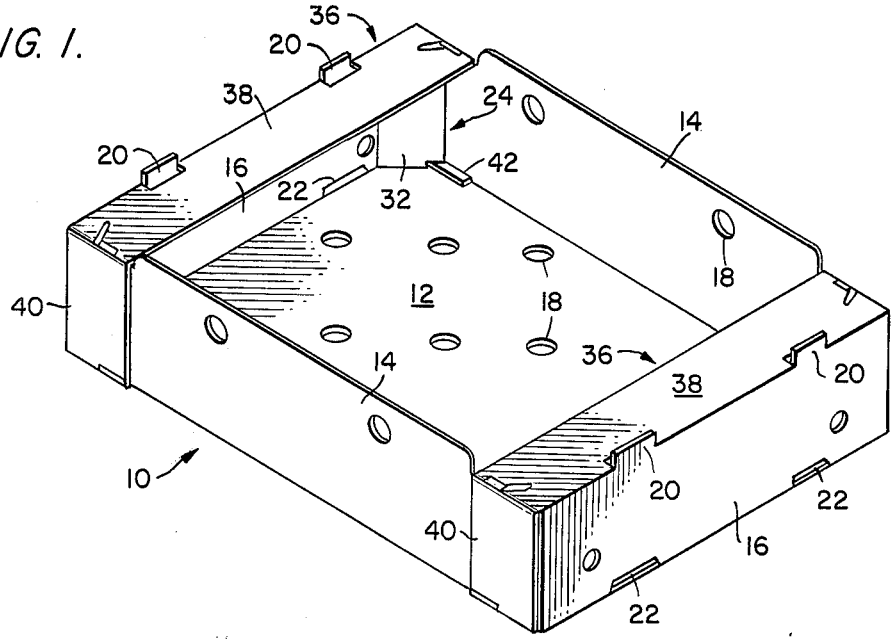
FIG. 1 is a perspective view of a rectangular tray incorporating the reinforced corner construction of the invention.

In the drawing illustrations and description hereinafter, it is contemplated that the tray is preferably constructed of a semi-rigid material such as cardboard or corrugated paperboard. The tray is particularly well suited to the packing and shipping of produce such as cauliflower. However, it is to be understood that the tray of this invention may be fabricated of any other suitable material and also may be used for packing, shipment, storage, etc. of any product, object or material.

Figure 3:
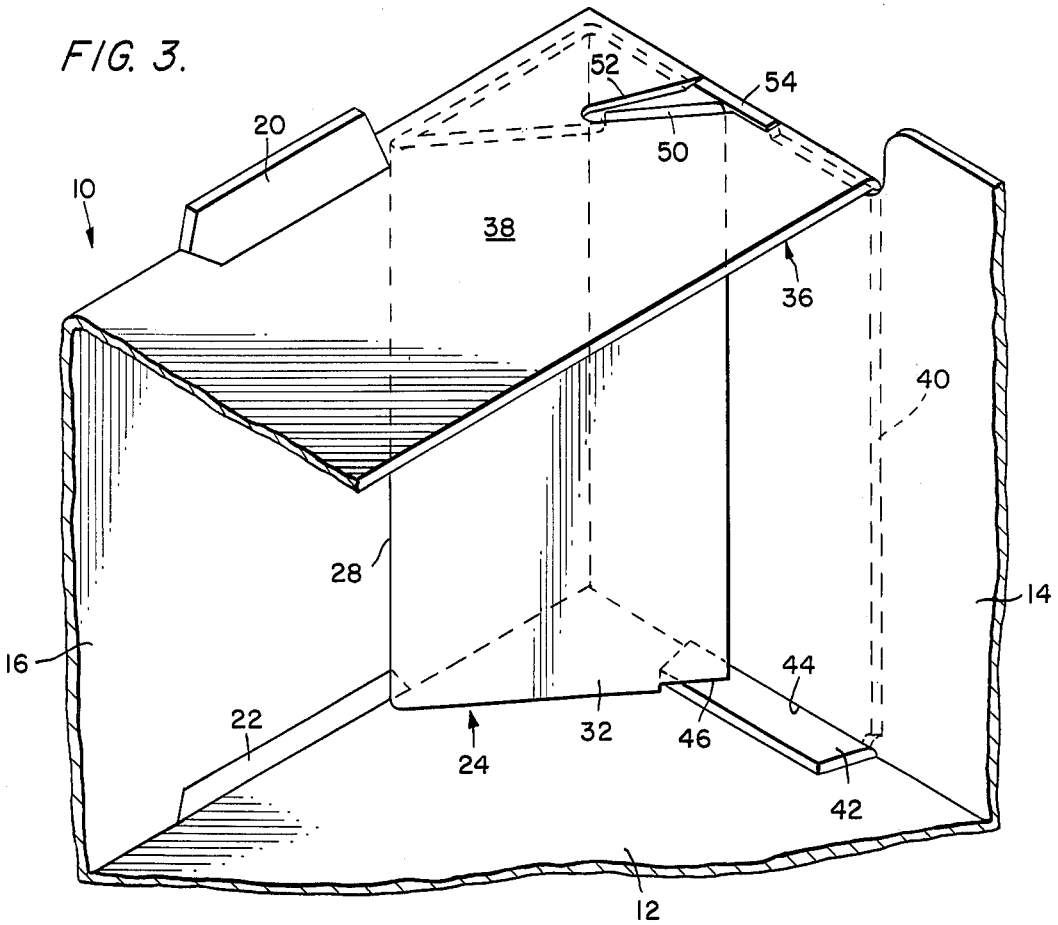
FIG. 3 is a fragmentary perspective of a reinforced tray corner made in accordance with the invention.
Figure 4:
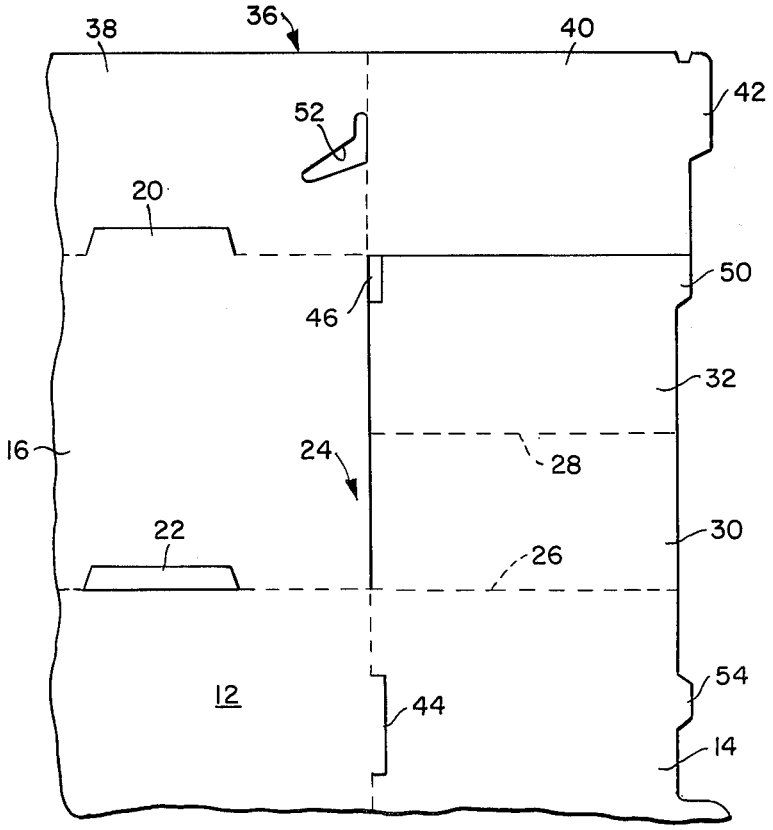
FIG. 4 is a plan view of a corner segment of the generally rectangular tray panel blank which is appropriately cut and scored to be folded into the tray corner of FIG. 3.

It also would be recognized that the rectangular tray 10 such as shown in its complete form on FIG. 1 is formed from a single generally rectangular panel blank which has been suitably cut, scored, perforated, etc. to be folded into the completed tray 10 of FIG. 1. In its complete form tray 10 has reinforced corners at each of the four corners thereof but for effective large scale illustration of the invention, FIG. 4 shows only a segment of the panel blank which would be folded into one reinforced corner and FIGS. 3, 5 and 6 also only show a single corner fragment for the rectangular tray 10.

Figure 2:
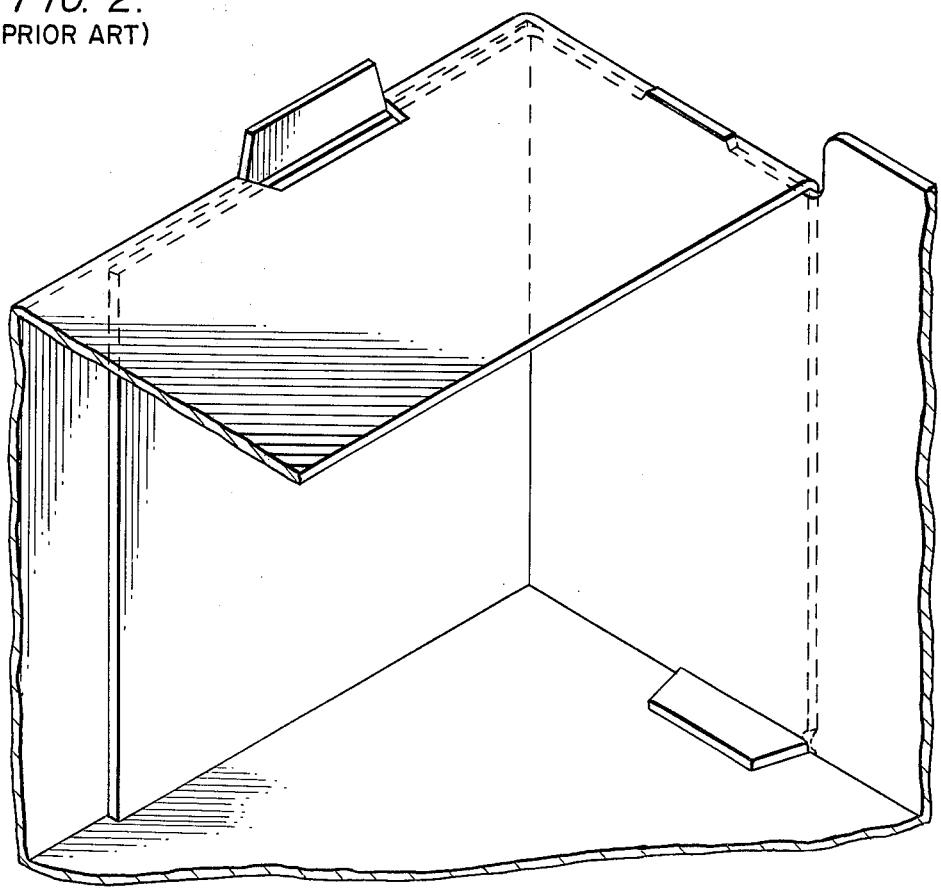
FIG. 2. (PRIOR ART)
FIG. 2 is a fragmentary perspective view of a corner construction employed in one form of prior art tray.

It will be noted that FIG. 2 is identified as showing a corner construction characteristic of rectangular trays suitable for produce that is known in the prior art. The features lacking in the prior art corner construction of FIG. 2 in relation to the invention herein will become apparent from the description hereinafter, given in relation to FIGS. 1 and 3–6.

Referring to FIG. 1 on the drawings, the suitably cut and scored panel blank that is folded into the configuration of rectangular tray 10 provides a bottom wall 12 with opposed side walls 14 folded upwardly to be hingedly connected to and extend upwardly from opposite side edges of the bottom wall 12. Similarly, a pair of opposed end walls 16 are folded upwardly and thus hingedly connected to and extend upwardly from the other pair of opposite side edges of the bottom wall 12. These two pairs of walls 14 and 16 form the four sides of the tray to substantially define the dimensions of the tray as they are associated with bottom wall 12.

Before proceeding with a detailed description of the corner reinforcing construction, which is significant in the tray invention, it may be noted that for its intended purpose as a produce tray for cauliflower and the like the tray 10 is illustrated on FIG. 1 with conventional ventilating holes 18 and stacking tabs 20. As known in the art, stacking tabs are commonly provided to facilitate stacking alignment of a multiplicity of cartons, trays, etc. for their transport, storage, etc. Likewise, cutouts 22 spaced along the juncture of end wall 16 with bottom wall 12 are shown located to receive the stacking tabs 20 of a tray therebeneath; also as known in the prior art. These features are acknowledged as forming no part of the instant invention and are shown simply to better display the environment in which the reinforced tray corner of the invention may be most suitably employed.

Figure 5:
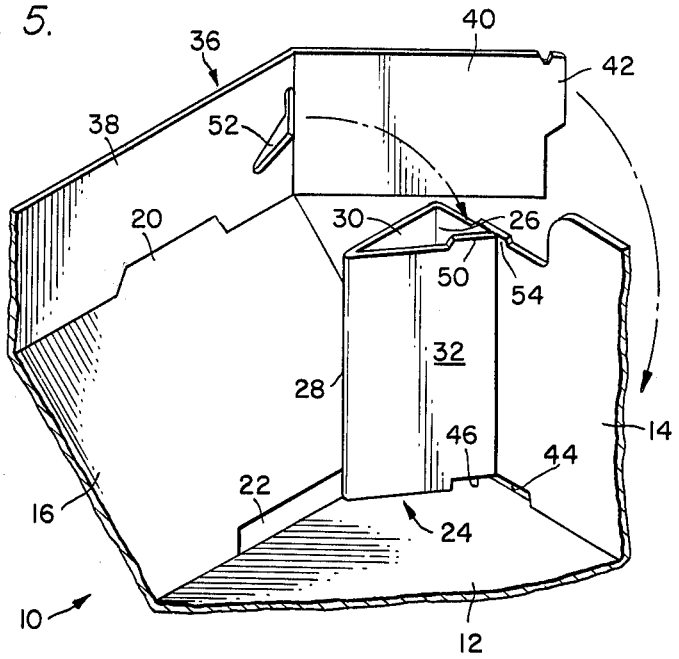
FIG. 5 is a view diagrammatically illustrating folding the blank corner segment of FIG. 4 into the tray corner of FIG. 3.

The side wall 14 has a corner flap 24 extending longitudinally therefrom. This corner flap is folded into a columnar configuration at the end of the side wall. As may be best seen from FIG. 4, the corner flap 24 is folded twice along the score lines 26 and 28 to provide a pair of wall portions 30 and 32 which define a triangular column with the end portion of guide wall 14 when the corner flap is folded into this columnar configuration at the end of side wall 14. Referring to FIG. 5, it will be seen that the wall portion 30 of corner flap 24 is folded along line 26 to be perpendicular to wall 14 while wall portion 32 is folded along line 28 to extend diagonally across the right angle corner formed by wall portion 30 and the end portion of side wall 14.

The end wall 16 which adjoins the side wall 14 has a top flap 36 which extends upwardly from the end wall 16 and is folded down in forming the tray 10 to provide a partial top wall 38. This partial top wall then overlies the columnar configuration generated by folding corner flap 24 into the relationship of the wall portions 30 and 32 of corner flap 24.

Further, the top flap 36 includes a locking flap 40 which extends longitudinally from the top flap as may easily be seen from the panel blank segment shown on FIG. 4. This locking flap 40 is folded down to lie along the outside of the side wall 14. Locking flap 40 is provided with a holding tab 42 on one edge thereof and a slot 44 is formed in the panel blank adjacent the juncture of side wall 14 with bottom wall 12. With the locking flap 40 folded down to lie along the outside of side wall 14, the holding tab 42 is inserted into the slot 44 as best seen on FIG. 3, thereby forming a holding means to maintain the walls of the panel blank in the desired configuration for tray 10.

To facilitate folding the wall portion 32 of corner flap 24 into its intended columnar configuration while accommodating holding tab 42 on locking flap 40 as it projects through slot 44, the edge of wall portion 32 may be notched at 46.

Figure 6:
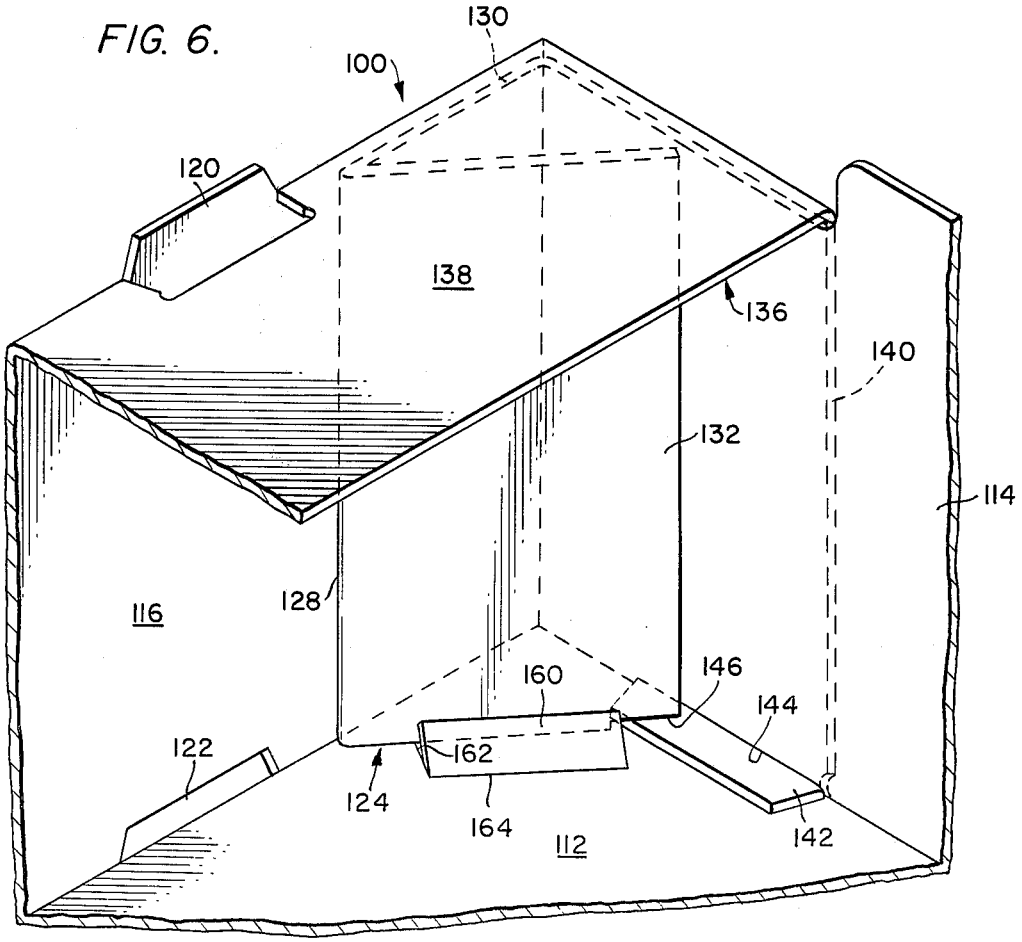
FIG. 6 is a fragmentary perspective, similar to FIG. 3, showing an alternative of the reinforced tray corner invention.

The columnar configuration which provides reinforcement at the corner of the tray and is formed by folding corner flap 24 into a pair of wall portions 30 and 32, is retained in this configuration so as to be disposed between the bottom wall 12 and partial top wall 38 of top flap 36 by a suitable retaining means. In the embodiment specifically illustrated on FIGS. 1 and 3–5 this retaining means is formed by a retaining tab on an edge of the corner flap engaging in an opening formed on one of the walls adjacent the corner flap edge. In the embodiment of FIG. 6, this retaining means is provided by a retaining tongue incised from one of the walls adjacent the corner flap for such tongue to engage one of the wall portions of the corner flap.

First, describing the specifically illustrated structure of FIGS. 1 and 3–5, the wall portion 32 of corner flap 24 has a retaining tab 50 formed on the edge of wall portion 32 which underlies the partial top wall 38 that is provided by top flap 36. In turn, the partial top wall 38 of top flap 36 has a generally triangular opening 52 formed therein so that the retaining tab 50 on the wall portion 32 of corner flap 24 engages in opening 52 thereby serving to retain the columnar configuration in proper position between the bottom wall 12 and partial top wall 38.

Whereas in the specific embodiment illustrated, the retaining tab 50 is on the edge of corner flap wall portion 32 which underlies the partial top wall 38 and engages opening 52 in such top wall, it will be recognized that the retaining means for the columnar configuration may be provided by a retaining tab like 50 but disposed on a different edge of the corner flap wall portion 32 and engaging with an opening appropriately located in a wall adjacent the corner flap wall portion 32 other than partial top wall 38 of top flat 36.

To further rigidify the reinforced corner of the tray 10, a locating tab 54 is provided on side wall 14 extending from the side wall edge remote from the hinged fold connection of such side wall with bottom wall 12. This locating tab 54 engages in the generally triangular opening 52 in the angular relation to retaining tab 50 on wall portion 32 of corner flap 24 as shown on FIG. 3. Thus, not only does tab 50 serve to retain the columnar configuration for the folded corner flap 24 but also the locating tab 54 on side wall 14 by engaging in triangular opening 52 along with tab 50 assists in rigidifying the corner construction. This rigidity is enhanced by holding tab 42 on locking flap 40 being engaged with slot 44, all as shown in the assembled corner construction on FIG. 3.

From the above description, the steps taken in folding the generally rectangular panel blank which has been suitably cut and scored in accordance with the above described construction into the rectangular tray 10 with reinforced corners at the four corners of such tray should be readily apparent. FIG. 4 shows a corner segment of such a panel blank and FIG. 5 diagrammatically illustrates the steps undertaken in folding a corner segment of an appropriate panel blank into the rectangular tray 10.

For example, the opposed side walls 14 are folded to extend upwardly perpendicular to the bottom wall 12 to which they remain hingedly connected. The corner flaps 24 at the opposite ends of each side wall 14 are twice folded so that a triangular column is created at each end of both side walls 14. Then the opposed end walls 16 can be folded to extend upwardly from the opposite edges of the bottom wall 12 to which they remain hingedly connected. The top flaps 36 are then folded down to provide partial top walls 38 overlying the triangular columns at the ends of the side walls 14. Each locking flap 40 at the opposite ends of the top flap 36 is folded down to lie along the outside of the adjoining side wall 14 and its holding tab 42 inserted into the slot 44 which lies at the juncture of the side wall 14 with the bottom wall 12.

These operative steps effectively result in retaining tab 50 and locating tab 54 both entering the appropriate triangular opening 52 in the partial top wall 38 of each top flap 36. Consequently, the walls become firmly held and retained in the tray configuration with the columnar configuration, in the form of a triangular column, reinforcing each of the corners of tray 10. Importantly, the triangular column is nested into the corner between adjoining side wall 14 and end wall 16 so as to provide necessary corner strength for the tray as important in stacking loaded trays while still not obstructing the interior dimensions of tray 10. Thus, maximum storage capacity is retained within the tray dimensions while still achieving high reinforced corner strength for the tray 10.

Whereas in the specifically illustrated embodiment the corner flap 24 is folded twice to provide a pair of wall portions 30 and 32 that form a triangular column with an end portion of the side wall 14, it should be understood that the corner flap 32 might be folded more than twice, such as to form a box-like columnar configuration, all within the intended scope of the appended claims.

Description of the second specifically disclosed embodiment shown on FIG. 6 may be given simply by distinguishing the elements that correspond in function or are similar to those of the above described embodiment by utilizing a three-digit reference numeral series.

Thus on FIG. 6 elements comparable to those found in the first embodiment described above are simply designated by numerals in the one hundred series. The description of each such element will not be repeated and only the elements differing from those of the embodiment of FIGS. 1 and 3–5 need be commented on.

It will be understood that a generally rectangular panel blank that has been suitably cut and scored will be folded for the rectangular tray 100 to have four reinforced corners comparable to those at the four corners of tray 10. FIG. 6 simply illustrates the folded reinforced corner construction for one of such corners on tray 100, the FIG. 6 illustration being comparable to FIG. 3 in its showing of the first embodiment.

In the embodiment of FIG. 6, the retaining means which cooperates with the corner flap 124 to retain it in its columnar configuration to be disposed between the bottom wall 112 and partial top wall 138 on top flat 136 is provided by a retaining tongue 160. This tongue is shown as being incised from the bottom wall 112 as by a three-sided cut 162 in such wall freeing the tongue 160 to be bent upwardly along score line 164 after the wall portion 132 of the corner flap 124 has been properly folded into position as shown in FIG. 6. In this relationship of retaining tongue 160 to the corner flap 124 the tongue engages the wall portion 132 of such corner flap to retain the columnar configuration in the reinforced tray corner construction.

Whereas in FIG. 6 the retaining tongue 160 has been shown incised from the bottom wall 112 of the tray 100 it will be recognized that an appropriate retaining tongue to perform the same function in retaining the columnar configuration of corner flap 124 could be incised from a wall adjacent corner flap 124 other than bottom wall 112.

The assembly steps commencing from a panel blank suitably cut and scored as appropriate in constructing tray 100 are closely similar to those employed in the first embodiment assembly as are described in detail hereinabove. In the FIG. 6 embodiment it will be appreciated that once the folding steps have progressed to the point that the retaining means for the columnar configuration formed by corner flap 124 is called for, it activation simply involves pressing the retaining tongue 160 out of the plane of bottom wall 112 along cut 162, bending it about score line 164 until the tongue projects upwardly to engage the wall portion 132 of corner flap 124 and thereby effectively retain the columnar configuration in its nested position within the corner of tray 100. Obviously, similarly located retaining tongues 160 at each of the four corners of tray 100 will be pressed out of the plane of the bottom wall 112 to appropriately retain the columnar configuration at each of the four corners of the tray 100.

It should be appreciated from the above disclosure of the invention including illustration and description of two embodiments of such invention that the rectangular tray 10 or 100 may be easily folded from a single generally rectangular blank into a strong quite rigid tray with reinforced corners for substantial load carrying abilities in stacking a multiple of such trays loaded with produce such as cauliflower or other products. While the produce tray may find particular applicability in being loaded, stored and transporting produce it will be recognized that it is subject to utilization in a multitude of environments other than with produce.

Further, it is to be understood that the embodiments of the invention herein shown and described must be taken only as preferred representations of the invention. Thus, it will be obvious to one of ordinary skill in the art that numerous modifications and changes may be made without departing from the true spirit and scope of the invention which is to be limited only by the appended claims.

What is claimed is:

1. A rectangular tray suitable for produce such as cauliflower and the like comprising:

a panel blank providing pairs of opposed side and end walls hingedly connected to and extending upwardly from the edges of a bottom wall to substantially define the dimensions of said tray;

a corner flap extending longitudinally from a first of said side walls, said flap being folded into a columnar configuration at the end of said side wall;

a top flap extending upwardly from one of said end walls that adjoins said first side wall, said top flap being folded down to provide a partial top wall overlying said columnar configuration;

a locking flap extending longitudinally from said top flap and having a holding tab on an edge thereof, said locking flap being folded down to lie along the outside of said first side wall;

a slot formed on said panel blank with said holding tab being engaged in said slot to maintain said walls in the tray configuration; and retaining means cooperating with said corner flap to retain said columnar configuration disposed between said bottom wall and said partial top wall, the free edge of said corner flap being notched to accommodate said holding tab.

2. A rectangular tray as recited in claim 1 wherein said slot is formed adjacent the juncture of said first side wall with said bottom wall.

3. A rectangular tray as recited in claim 1 wherein said corner flap is folded twice to provide a pair of wall portions which define a triangular column with an end portion of said first side wall.

4. A rectangular tray suitable for produce such as cauliflower and the like comprising:

a panel blank providing pairs of opposed side and end walls hingedly connected to and extending upwardly from the edges of a bottom wall to substantially define the dimensions of said tray;

a corner flap extending longitudinally from a first of said side walls, said flap being folded into a columnar configuration at the end of said side wall;

a top flap extending upwardly from one of said end walls that adjoins said first side wall, said top flap being folded down to provide a partial top wall overlying said columnar configuration and having holding means to maintain said walls in the tray configuration; and retaining means cooperating with said corner flap to retain said columnar configuration disposed between said bottom wall and said partial top wall, said retaining means comprising a retaining tab on an edge of said corner flap and an opening formed in one of said walls with said retaining tab being engaged in said opening.

5. A rectangular tray as recited in claim 4 wherein said opening is formed in said partial top wall.

6. A rectangular tray suitable for produce such a cauliflower and the like comprising:

a panel blank providing pairs of opposed side and end walls hingedly connected to and extending upwardly from the edges of a bottom wall to substantially define the dimensions of said tray;

a corner flap extending longitudinally from a first of said side walls, said flap being folded into a columnar configuration at the end of said side wall;

a top flap extending upwardly from one of said end walls that adjoins said first side wall, said top flap being folded down to provide a partial top wall overlying said columnar configuration and having holding means to maintain said walls in the tray configuration; and retaining means cooperating with said corner flap to retain said columnar configuration disposed between said bottom wall and said partial top wall, said retaining means comprising a retaining tongue incised from one of said walls, said tongue engaging a wall portion of said corner flap to retain said columnar configuration, the free edge of said corner flap accommodating said holding tab.

7. A rectangular tray as recited in claim 6 wherein said tongue is incised from said bottom wall to engage with a wall portion of said corner flap.

* * * * *